US007967295B1

(12) United States Patent
Laukaitus

(10) Patent No.: US 7,967,295 B1
(45) Date of Patent: Jun. 28, 2011

(54) HORSESHOE RETRIEVER AND METHOD OF PLAYING A GAME OF HORSESHOES USING THE RETRIEVER

(76) Inventor: Joseph C. Laukaitus, Houston, TX (US)

( * ) Notice: Subject to any disclaimer, the term of this patent is extended or adjusted under 35 U.S.C. 154(b) by 0 days.

(21) Appl. No.: 12/590,829

(22) Filed: Nov. 16, 2009

(51) Int. Cl.
*A63B 67/06* (2006.01)
*A63B 65/00* (2006.01)
*A63B 65/10* (2006.01)

(52) U.S. Cl. ..... 273/336; 273/317

(58) Field of Classification Search ..... 273/317, 273/336, 337, 338, 343; 194/19.1, 19.2
See application file for complete search history.

(56) References Cited

U.S. PATENT DOCUMENTS

| | | | | | |
|---|---|---|---|---|---|
| 2,009,252 | A | * | 7/1935 | Erickson | 273/337 |
| 2,265,517 | A | * | 12/1941 | Clement | 273/336 |
| 4,076,004 | A | * | 2/1978 | Huelskamp | 124/5 |
| 4,130,281 | A | | 12/1978 | Leber et al. | |
| 4,273,340 | A | | 6/1981 | Hackett | |
| 4,805,916 | A | * | 2/1989 | Zentner, Jr. | 273/336 |
| 4,819,947 | A | * | 4/1989 | Mackey | 273/412 |
| 4,880,242 | A | | 11/1989 | White | |
| 4,927,159 | A | | 5/1990 | Morrissey et al. | |
| 5,201,526 | A | * | 4/1993 | Ketcham, Jr. | 273/342 |
| 5,358,256 | A | * | 10/1994 | Kraemer | 273/401 |
| 5,971,396 | A | | 10/1999 | Wieland | |
| 2008/0029963 | A1 | * | 2/2008 | Cornfield | 273/336 |

* cited by examiner

*Primary Examiner* — Raleigh W. Chiu
(74) *Attorney, Agent, or Firm* — Richard L. Mikesell

(57) ABSTRACT

A horseshoe tossing game which includes retrieving a tossed horseshoe by means of a device which includes a horseshoe grabbing hook-shaped element on one end of a handle and a cap on the other end of the handle. The handle is grasped and the hook-shaped element is positioned around the tossed horseshoe and the horseshoe lifted to the hand of the user.

2 Claims, 1 Drawing Sheet

HORSESHOE RETRIEVER AND METHOD OF PLAYING A GAME OF HORSESHOES USING THE RETRIEVER

TECHNICAL FIELD OF THE INVENTION

The present invention relates to the general art of tossing games, and to the particular field of horseshoe tossing games.

BACKGROUND OF THE INVENTION

Various games have been heretofore developed in which a game projectile is projected toward an object with a point value being ascribed to the resulting proximity of the game projectile to the object. For example, in the classic game of horseshoes, a player projects a U-shaped game projectile toward a vertical post. Differing point values are ascribed depending on whether the horseshoe surrounds the post or whether the inner surface of the horseshoe touches the post. In the classic game of horseshoes, the horseshoe defines a single opening and a single area which may receive the post.

Typically, in the prior art, to play the well-known game of "horseshoes" requires a playing field of sufficient size to incorporate the conventional distance between the required stakes of approximately 40 feet. Due to the size of the playing field and the need to have a soft substance, such as sand, surrounding the stakes, horseshoes is typically played outdoors and is a game well known throughout the world, although the agreed rules for any particular game are subject to local variation. Briefly, the game is played by players taking turns throwing/pitching a full-size metal horseshoe (often specially made as a large "pitching horseshoe") at a usually-metal vertical stake firmly set in the ground. Each player throws/pitches from about one stake to the other and can score specified points depending upon whether the player makes a "ringer" (if the horseshoe is curled around the stake), a "leaner" (if the it is leaning on the stake), or touching or close within a specified distance, etc., etc.; and a player may move a previously pitched horseshoe to a scoring or non-scoring position as a result of a later pitch.

However, each pitch in a horseshoe tossing game requires the player to retrieve the horseshoe. This requires bending over to grasp the horseshoe and then straightening up with the retrieved horseshoe. While this process sounds basic and simple, it can be painful for anyone with back problems. Furthermore, this process will be repeated numerous times during a tournament. Such a process can be wearing and may impact the player's skill if he or she does not have sufficient stamina.

Therefore, there is a need for a means for and a method of retrieving a tossed horseshoe in an expeditious and easy manner which does not place undue stress on the player's back.

SUMMARY OF THE INVENTION

The above-discussed disadvantages of the prior art are overcome by a horseshoe tossing game which includes retrieving a tossed horseshoe by means of a device which includes a horseshoe grabbing hook-shaped element on one end of a handle and a cap on the other end of the handle. The handle is grasped and the hook-shaped element is positioned around the tossed horseshoe and the horseshoe lifted to the hand of the user.

Using the means and method embodying the present invention will permit a horseshoe player to retrieve tossed horseshoes without bending over thereby saving his or her back from pain and/or fatigue.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figures 1, 2:
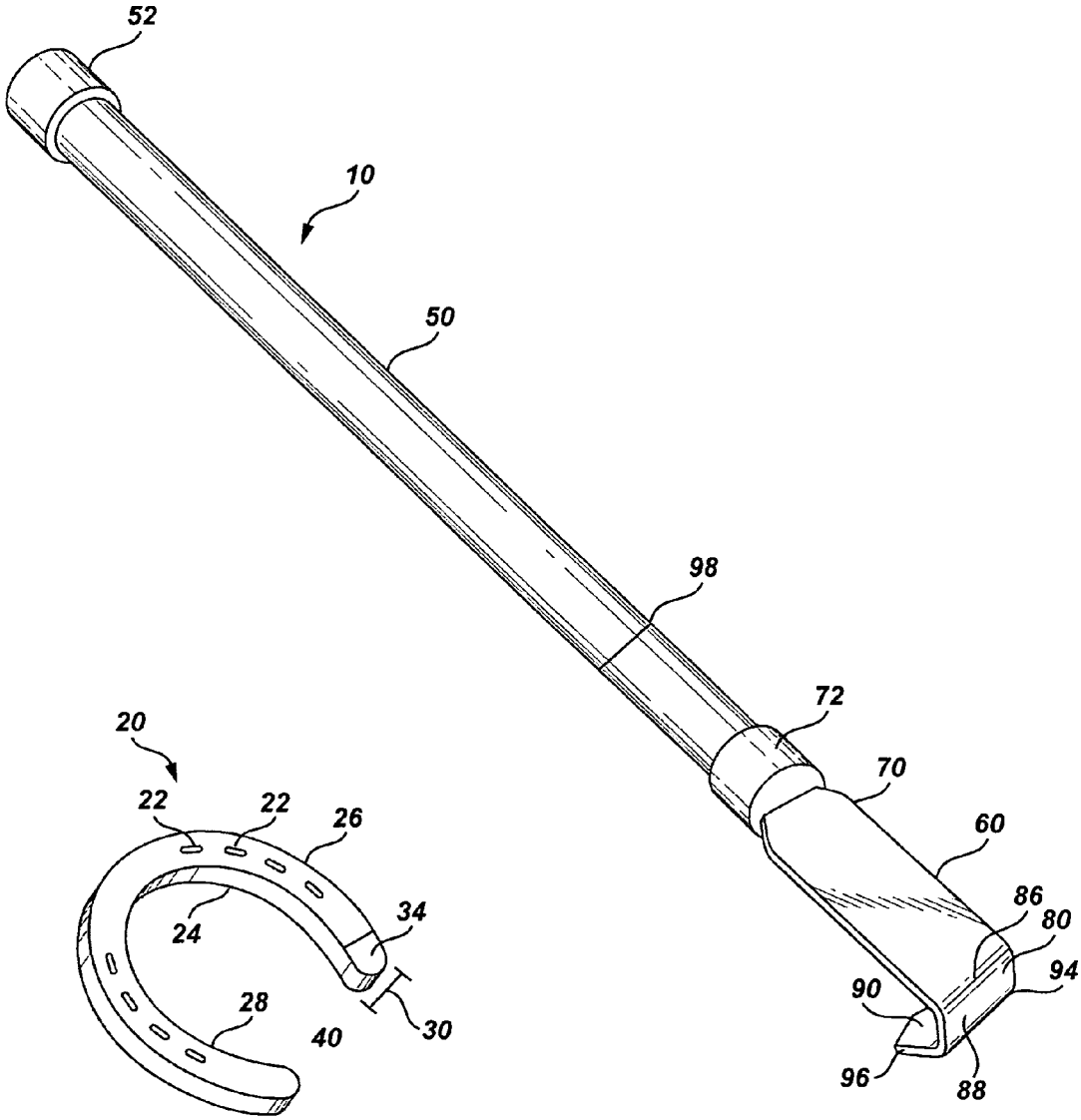
FIG. 1 is a perspective view of a tossed horseshoe retriever embodying the principles of the present invention.
FIG. 2 is a perspective view of a horseshoe.

Referring to the figures, it can be understood that the present invention is embodied in a tossing game of horseshoes which includes establishing a target, such as a post located in a pit or the like, defining a prescribed distance away from that target and tossing a horseshoe at the target. Another round of the game is played by first retrieving the tossed horseshoe and repeating the just-mentioned process. The retrieval step of the process requires, in the prior art, that the player bend over, pick up the tossed horseshoe and then straighten up. As discussed above, this step may place pressure on the player's back, which can be painful to a person with an injured back or can wear on a player during a long tournament.

The retriever 10 shown in FIG. 1 will alleviate the just-mentioned problems during a game of horseshoe tossing.

First referring to FIG. 2, a horseshoe 20, such as one which will be used in a game of horseshoe tossing, includes a first surface 22, a second surface 24 and two side surfaces 26 and 28, with a thickness dimension 30 extending between the two surfaces 22 and 24 and a width dimension 34 extending between the two side surfaces 26 and 28. As is common in the game of horseshoe tossing, the horseshoe is gripped and tossed so that a target will pass through open portion 40 of the horseshoe when the horseshoe reaches the target. The horseshoe will then lie adjacent to the target and be retrieved by the player for the next round.

Retriever 10 is adapted to perform the retrieving process while eliminating the need of the player to bend over to retrieve the tossed horseshoe. Retriever includes a handle 50 having a cap 52 on one end thereof and a U-shaped hook element 60 mounted on the other end thereof. Retriever 10 has an axial length as measured between cap 52 and element 60 of approximately thirty-five inches so it will be long enough to allow retrieving a tossed horseshoe, but not so long as to be cumbersome.

Element 60 includes a base section 70 attached to the handle by a cap element 72 and which extends in the longitudinal direction of the handle. A first section 80 is located on a distal end 86 of base section 70 and extends at a 45° angle away from the plane of the base section and away from the handle. The first section is sized so that it has a length as measured from end 94 which is unitary with end 86 of base section 70 to end 88 which is a distal end of the first section that is essentially equal to the thickness dimension of the horseshoe. A second section 90 has a first end 94 unitary with the distal end of the first section and a second end 96 which is a distal end. The second section is oriented to extend essentially perpendicular to transverse axis 98 of the handle and is sized so that the distance between first end 94 and second end 96 is essentially equal to the thickness dimension of the horseshoe.

The sizing of the sections of element 60 permits that element to snugly accommodate horseshoe 20 therein when the element is positioned around the horseshoe. The teeth permit the element to dig under a horseshoe lying on the ground when the retriever is being positioned to lift the tossed horseshoe.

Thus, a game of horseshoe tossing as described above will include a further step of using the just-described retriever to pick up a tossed horseshoe without requiring a player to bend over. The retriever is grasped by the handle and element 60 pushed under the tossed horseshoe until the horseshoe is grasped by the element. The handle is then pulled up to lift the horseshoe to the hand of the player.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A device for use in playing a horseshoe tossing game comprising:

A) a horseshoe;

B) a handle which has a first end and a second end;

C) a hook-shaped element mounted on one end of the handle, the hook-shaped element having a first section which is oriented at a 45° with respect to the handle, a second section which extends from the first section, the second section of the hook-shaped element extending from the first section by a distance sufficient to accommodate the horseshoe in the hook-shaped element in a manner which allows the horseshoe to be lifted by the handle-mounted hook-shaped element using the handle.

2. The device defined in claim 1 wherein the horseshoe includes a first surface, a second surface, two side surfaces, a thickness dimension defined between the first and second surface, and a width dimension defined between the two side surfaces, the first section extending away from the handle a distance essentially equal to the thickness dimension of the horseshoe, the second section extending from the first section a distance essentially equal to the thickness dimension of the horseshoe whereby the horseshoe is snugly accommodated in the hook when the hook is located around the horseshoe.

* * * * *